US010982168B2

(12) United States Patent
Takeshima

(10) Patent No.: US 10,982,168 B2
(45) Date of Patent: Apr. 20, 2021

(54) CYLINDER LUBRICATING OIL COMPOSITION FOR CROSSHEAD DIESEL ENGINE

(71) Applicant: ENEOS Corporation, Tokyo (JP)

(72) Inventor: Shigeki Takeshima, Tokyo (JP)

(73) Assignee: ENEOS CORPORATION, Tokyo (JP)

( * ) Notice: Subject to any disclaimer, the term of this patent is extended or adjusted under 35 U.S.C. 154(b) by 0 days.

(21) Appl. No.: 15/761,681

(22) PCT Filed: Sep. 27, 2016

(86) PCT No.: PCT/JP2016/078450

§ 371 (c)(1),
(2) Date: Mar. 20, 2018

(87) PCT Pub. No.: WO2017/057361

PCT Pub. Date: Apr. 6, 2017

(65) Prior Publication Data

US 2018/0346842 A1 Dec. 6, 2018

(30) Foreign Application Priority Data

Sep. 28, 2015 (JP) ..... JP2015-190029
Sep. 28, 2015 (JP) ..... JP2015-190060

(51) Int. Cl.

| | |
|---|---|
| ***C10M 163/00*** | (2006.01) |
| ***C10M 171/00*** | (2006.01) |
| ***C10M 171/04*** | (2006.01) |
| *C10N 10/04* | (2006.01) |
| *C10N 10/12* | (2006.01) |
| *C10N 20/04* | (2006.01) |
| *C10N 30/00* | (2006.01) |
| *C10N 40/26* | (2006.01) |
| *C10N 40/25* | (2006.01) |
| *C10M 133/56* | (2006.01) |
| *C10M 135/04* | (2006.01) |
| *C10M 135/06* | (2006.01) |
| *C10M 135/18* | (2006.01) |
| *C10M 135/20* | (2006.01) |
| *C10M 135/36* | (2006.01) |
| *C10M 137/10* | (2006.01) |
| *C10M 159/18* | (2006.01) |
| *C10M 159/22* | (2006.01) |
| *C10M 159/24* | (2006.01) |
| *C10M 133/06* | (2006.01) |
| *C10M 133/12* | (2006.01) |

(Continued)

(52) U.S. Cl.

CPC ..... *C10M 163/00* (2013.01); *C10M 171/00* (2013.01); *C10M 171/04* (2013.01); *C10M 133/06* (2013.01); *C10M 133/12* (2013.01); *C10M 133/16* (2013.01); *C10M 133/56* (2013.01); *C10M 135/04* (2013.01); *C10M 135/06* (2013.01); *C10M 135/18* (2013.01); *C10M 135/20* (2013.01); *C10M 135/36* (2013.01); *C10M 137/10* (2013.01); *C10M 159/18* (2013.01); *C10M 159/22* (2013.01); *C10M 159/24* (2013.01); *C10M 2203/1006* (2013.01); *C10M 2203/1025* (2013.01); *C10M 2203/1045* (2013.01); *C10M 2207/026* (2013.01); *C10M 2207/028* (2013.01); *C10M 2207/262* (2013.01); *C10M 2215/02* (2013.01); *C10M 2215/064* (2013.01); *C10M 2215/28* (2013.01); *C10M 2219/024* (2013.01); *C10M 2219/046* (2013.01); *C10M 2219/068* (2013.01); *C10M 2219/106* (2013.01); *C10M 2219/108* (2013.01); *C10M 2223/045* (2013.01); *C10N 2010/04* (2013.01); *C10N 2010/12* (2013.01); *C10N 2020/04* (2013.01); *C10N 2030/04* (2013.01); *C10N 2030/10* (2013.01); *C10N 2030/45* (2020.05); *C10N 2030/52* (2020.05); *C10N 2030/78* (2020.05); *C10N 2040/251* (2020.05); *C10N 2040/252* (2020.05); *C10N 2040/26* (2013.01)

(58) Field of Classification Search

CPC ..... C10M 2215/064; C10M 2223/045; C10M 2219/046; C10M 2207/028; C10N 2040/251; C10N 2030/54

See application file for complete search history.

(56) References Cited

U.S. PATENT DOCUMENTS

2004/0242436 A1* 12/2004 Ryan, III ..... C10M 169/04 508/382
2007/0179070 A1* 8/2007 Kurihara ..... C10M 163/00 508/460

(Continued)

FOREIGN PATENT DOCUMENTS

EP 2518134 10/2012
EP 2703477 3/2014

(Continued)

OTHER PUBLICATIONS

Hirose et al., "Technical Challenge for the 2-stroke Premixed Combustion Gas Engine (Pre-ignition Behavior and Overcoming Technique)", Paper No. 185, Proceeding of the 27th CIMAC congress, May 2013.

(Continued)

*Primary Examiner* — Vishal V Vasisth

(74) *Attorney, Agent, or Firm* — Greenblum & Bernstein, P.L.C.

(57) ABSTRACT

(1) A cylinder lubricating oil composition for a crosshead diesel engine, the composition having: a sulfated ash content of 2.0 to 5.5 mass %; a base number of 15 to 45 mgKOH/g; and an autoignition temperature of no less than 262° C. (2) A cylinder lubricating oil composition for a crosshead diesel engine, comprising: a lubricant base oil; (B) a Ca sulfonate detergent having a base number of no less than 10 mgKOH/g and less than 60 mgKOH/g; (C) a Ca phenate detergent having a base number of 55 to 200 mgKOH/g; (D') an amine antioxidant; and (E') a zinc dithiophosphate, wherein the composition has a base number of no less than 15 mgKOH/g and less than 120 mgKOH/g.

12 Claims, No Drawings

(51) Int. Cl.

| | |
|---|---|
| *C10M 133/16* | (2006.01) |
| *C10N 30/04* | (2006.01) |
| *C10N 30/10* | (2006.01) |

(56) References Cited

U.S. PATENT DOCUMENTS

| | | | | |
|---|---|---|---|---|
| 2009/0143261 | A1* | 6/2009 | Takeoka | C10M 107/02 508/110 |
| 2012/0258897 | A1 | 10/2012 | Takeshima et al. | |
| 2012/0258898 | A1* | 10/2012 | Takeshima | C10M 143/08 508/370 |
| 2014/0360450 | A1 | 12/2014 | Dodd | |
| 2014/0378356 | A1 | 12/2014 | Takeshima et al. | |
| 2016/0230115 | A1* | 8/2016 | Mosier | C10M 169/04 |

FOREIGN PATENT DOCUMENTS

| | | | |
|---|---|---|---|
| JP | 2010-174091 | A | 8/2010 |
| JP | 2010-174092 | A | 8/2010 |
| JP | 2011-132338 | A | 7/2011 |
| WO | 2013/046755 | A1 | 4/2013 |

OTHER PUBLICATIONS

Yasueda et al., "Predicting Autoignition caused by Lubricating Oil in Gas Engines", Paper No. 37, Proceedings of the 27th CIMAC congress, May 2013.

International Search Report issued in International Bureau of WIPO Patent Application No. PCT/JP2016/078450, dated Dec. 13, 2016.

International Preliminary Report on Patentability issued in International Bureau of WIPO Patent Application No. PCT/JP2016/078450, dated Apr. 3, 2018.

Kazuo Takeuchi et al., "Investigation of Engine Oil Effect of Abnormal Combustion in Turbocharged Direct Injection—Spark Ignition Engines", SAE International Journal of Fuels and Lubricants, 2012, vol. 5. No. 3, pp. 1017-1024.

* cited by examiner

CYLINDER LUBRICATING OIL COMPOSITION FOR CROSSHEAD DIESEL ENGINE

This application is a 371 of PCT/JP2016/078450, filed Sep. 27, 2016.

FIELD

The present invention relates to cylinder lubricating oil compositions for crosshead diesel engines.

BACKGROUND

Low-speed two-stroke crosshead diesel engines (hereinafter may be referred to as "two-stroke crosshead diesel engine", "crosshead diesel engine", or "crosshead engine") are widely used as main engines of marine vessels, especially of large marine vessels, because of their high thermal efficiency. Emissions from crosshead diesel engines thus have a great impact on environmental effects of operation of marine vessels.

As regards environmental effects of operation of marine vessels, IMO (International Maritime Organization) has decided to introduce stricter emission controls. For example, it is obliged to use a fuel having a sulfur content of no more than 0.1 mass % (ULSFO) in the controlled sea areas named ECA (Emission Control Area) from 2015. Further, introduction of further regulation to make it mandatory for marine vessels without exhaust gas desulfurization equipment to use a fuel having a sulfur content of no more than 0.5 mass % even in general sea areas from 2020 (or 2025), is under consideration.

So as to comply with such regulations, low-sulfur fuels (sulfur content: 0.1 mass % or less) prepared from distillate oils or hydrocracked bottoms as raw materials, are on the market. And also, crosshead engines which can use fuels such as liquefied natural gas (LNG), compressed natural gas (CNG), liquefied petroleum gas (LPG), ethylene, methanol, ethanol, and dimethyl ether (hereinafter may be referred to as "specific fuels"), have been developed. These specific fuels comprise $C_{1-4}$ hydrocarbons, and have low boiling points and low flash points. Further, these specific fuels are advantageous in that they are sulfur-free (having a sulfur content of 10 mass ppm or less) and therefore they do not cause catalyst poisoning by sulfur in exhaust gas purifiers. Especially LNG is also advantageous in view of fuel efficiency because of their lower $CO_2$ emission per unit heat compared to petroleum fuels such as distillate oils and heavy oils, and is expected to be stably supplied at a lower cost than petroleum fuels in the future, owing to development of shale gags fields.

CITATION LIST

Patent Literature

Patent Literature 1: JP 2011-132338 A
Patent Literature 2: JP 2010-174091 A
Patent Literature 3: JP 2010-174092 A
Patent Literature 4: WO 2013/046755 A1

Non Patent Literature

Non Patent Literature 1: S. Yasueda; L. Tozzi; E. Sotiropoulou, "Predicting Autoignition caused by Lubricating Oil in Gas Engines", Paper No. 37, Proceedings of the 27th CIMAC Congress, May 2013, Shanghai Non Patent Literature 2: T. Hirose; Y. Masuda; T. Yamada; Y. Umemoto; H. Furutani, "Technical Challenge for the 2-Stroke Premixed Combustion Gas Engine (Pre-ignition Behavior and Overcoming Technique)", Paper No. 185, Proceedings of the 27th CIMAC Congress, May 2013, Shanghai

SUMMARY

Technical Problem

As crosshead engines using the specific fuels, diesel cycle engines (gas injection engines) and Otto cycle engines (low-pressure premixing combustion engines) have been proposed. The diesel cycle engine injects a pilot fuel (generally a petroleum fuel) into a combustion chamber in advance, and thereafter, at the timing of ignition, injects a main fuel (specific fuel) to the combustion chamber, to make them ignited to burn. The Otto cycle engine mixes the main fuel and air in a combustion chamber to form a fuel-air mixture in advance, and thereafter, at the timing of ignition, injects the pilot fuel in the combustion chamber to make them ignited to burn.

In Otto cycle engines, ash deposits in a combustion chamber becomes an ignition source due to heat accumulation, which results in a phenomenon that the fuel-air mixture is ignited to burn before injection of the pilot fuel (Preignition). It has also been reported that a cylinder oil component in the cylinder becomes an ignition source and causes preignition (Non Patent Literature 1).

The first object of the present invention is to provide a cylinder lubricating oil composition for a crosshead diesel engine which is suitable for crosshead engines using specific fuels and is able to suppress preignition. A method for lubricating a cylinder of a crosshead diesel engine using the composition is also provided.

Recent crosshead engines tend to have increased mean effective pressure (Pme) due to increased stroke/bore ratio, so as to further improve efficiency. Increased mean effective pressure (i.e. higher power) results in increased maximum combustion pressure (Pmax). While sulfur oxides (SOx) form in crosshead engines due to combustion of sulfur content in the fuel, increased combustion pressure makes it easier for sulfuric acid etc. derived from SOx to condense onto a cylinder liner, which makes it easier for cylinder corrosion to occur. So as to prevent condensation of sulfuric acid etc. derived from SOx onto the cylinder liner, it has been proposed to increase cylinder liner wall temperature.

However, increased combustion pressure leads to increased ring face pressure on one hand, and increased cylinder liner wall temperature leads to reduced viscosity of a cylinder oil and thus to reduced cylinder oil film separating the ring and the linear on the other hand, which means severer lubricating conditions, resulting in a situation where scuffing easily occurs.

Addition of an anti-wear agent or an extreme-pressure agent is common as a method of improving anti-scuffing performance of general lubricating oils. However, the cylinder liner wall temperature of a crosshead engine becomes as high as 200° C. or even higher, and therefore conventional anti-wear agents and extreme-pressure agents decompose on the cylinder linear wall surface, which results in failure to exhibit their effect, or in consumption of other additives.

The second object of the present invention is to provide a cylinder lubricating oil composition for a crosshead diesel engine having improved high-temperature anti-scuffing performance. A method for improving high-temperature anti-scuffing performance of a crosshead diesel engine using the lubricating oil composition is also provided.

Solution to Problem

First and second aspects of the present invention solve the first object.

The first aspect of the present invention encompasses the following embodiments [1] to [10]:

[1] A cylinder lubricating oil composition for a crosshead diesel engine, the composition having: a sulfated ash content of 2.0 to 5.5 mass %; a base number of 15 to 45 mgKOH/g; and an autoignition temperature of no less than 262° C.;

[2] The lubricating oil composition according to [1], the composition being used for lubrication of a crosshead engine, the crosshead engine using a fuel, the fuel having a flash point of no more than 15° C.;

[3] The lubricating oil composition according to [1] or [2], the composition being used for lubrication of a crosshead engine, the crosshead engine using a fuel, the fuel comprising a hydrocarbon having 1 to 4 carbons;

[4] The lubricating oil composition according to any one of [1] to [3], the composition being used for lubrication of a crosshead engine, the crosshead engine using a fuel, the fuel comprising methane, ethane, ethylene, propane, butane, methanol, ethanol, dimethyl ether, or combination thereof;

[5] The lubricating oil composition according to any one of [1] to [4], the composition comprising: a lubricant base oil; (A) a Ca salicylate detergent having a metal ratio of no more than 7 and/or a Ca phenate detergent having a metal ratio of no more than 7; (B) a Ca sulfonate detergent having a base number of no less than 10 and less than 60 mgKOH/g; (C) a Ca phenate detergent having a base number of 55 to 200 mgKOH/g; (D) an amine antioxidant and/or a sulfur-containing compound; and (E) a zinc dithiophosphate or a zinc dithiocarbamate, wherein the sulfur-containing compound is a compound other than a metallic detergent, a zinc dithiophosphate, a zinc dithiocarbamate, an oil-soluble organic molybdenum compound, and an ashless detergent;

[6] The lubricating oil composition according to [5], the composition comprising: the component (B) in an amount of 100 to 1000 mass ppm in terms of Ca; the component (C) in an amount of 200 to 2000 mass ppm in terms of Ca; the component (D) in an amount of 0.10 to 5.0 mass %; and the component (E) in an amount of 100 to 700 mass ppm in terms of Zn, on the basis of the total mass of the composition;

[7] The lubricating oil composition according to [5] or [6], the component (D) comprising one or more selected from the group consisting of: alkylated diphenylamine, alkylated phenyl-α-naphthylamine, phenyl-α-naphthylamine, phenyl-β-naphthylamine, thiadiazole, disulfides, sulfurized fats, polysulfides, and sulfurized olefins;

[8] The lubricating oil composition according to any one of [5] to [7], further comprising: (F) an oil-soluble organic molybdenum compound;

[9] The lubricating oil composition according to [8], the component (F) comprising one or more selected from the group consisting of: molybdenum dithiocarbamate, molybdenum dithiophosphate, Mo-polyisobutenylsuccinimide complex, and dialkylamine salt of molybdic acids; and the composition comprising the component (F) in an amount of no less than 100 mass ppm in terms of Mo on the basis of the total mass of the composition; and

[10] The lubricating oil composition according to any one of [5] to [9], further comprising: (G) an ashless dispersant having a number average molecular weight of no less than 2500, wherein a product of the number average molecular weight of the component (G) and a content of the component (G) on the basis of the total mass of the composition (unit: mass %) is no less than 9000.

The second aspect of the present invention encompasses the following embodiments [11] to [13]:

[11] A method for lubricating a cylinder of a crosshead diesel engine, the method comprising: (a) operating a crosshead diesel engine using a fuel, the fuel having a flash point of no more than 15° C.; and (b) supplying the cylinder lubricating oil composition as in any one of [1] to [10] to a cylinder of the crosshead diesel engine;

[12] The method for lubricating the cylinder according to [11], wherein the fuel comprises a hydrocarbon having 1 to 4 carbons; and

[13] The method for lubricating the cylinder according to [11] or [12], wherein the fuel comprises methane, ethane, ethylene, propane, butane, methanol, ethanol, dimethyl ether, or combination thereof.

The third and fourth aspects of the present invention solve the second object.

Third aspect of the present invention encompasses the following embodiments [14] to [17]:

[14] A cylinder lubricating oil composition for a crosshead diesel engine, comprising:

a lubricant base oil;

(B) a Ca sulfonate detergent having a base number of no less than 10 mgKOH/g and less than 60 mgKOH/g;

(C) a Ca phenate detergent having a base number of 55 to 200 mgKOH/g;

(D') an amine antioxidant; and (E') a zinc dithiophosphate, wherein the composition has a base number of no less than 15 mgKOH/g and less than 120 mgKOH/g;

[15] The cylinder lubricating oil composition according to [14], the composition comprising:

the component (B) in an amount of 100 to 1000 mass ppm in terms of Ca on the basis of the total mass of the composition;

the component (C) in an amount of 100 to 2000 mass ppm in terms of Ca on the basis of the total mass of the composition;

the component (D') in an amount of 0.10 to 5.0 mass % on the basis of the total mass of the composition; and the component (E') in an amount of 100 to 700 mass ppm in terms of phosphorus on the basis of the total mass of the composition.

[16] The cylinder lubricating oil composition according to [15], further comprising:

(H) a metallic detergent other than the components (B) and (C), wherein the composition has a base number of 15 to 105 mgKOH/g; and

[17] The cylinder lubricating oil composition according to any one of [14] to [16], the component (D') comprising one or more selected from the group consisting of: alkylated diphenylamine, alkylated phenyl-α-naphthylamine, phenyl-α-naphthylamine, phenyl-β-naphthylamine, and phenothiazine.

The fourth aspect of the present invention encompasses the following embodiment [18]:

[18] A method for improving high-temperature anti-scuffing performance of a crosshead diesel engine, the method comprising:

supplying the cylinder lubricating oil composition as in any one of [14] to [17] to a cylinder of a crosshead diesel engine.

Advantageous Effects of Invention

Using the lubricating oil composition according to the first aspect of the present invention for lubricating a cylinder of a crosshead engine using a specific fuel makes it possible to suppress preignition.

According to the method for lubricating a cylinder of the second aspect of the present invention, a cylinder is lubricated using the lubricating oil composition according to the first aspect of the present invention, which makes it possible to suppress preignition in operation of a crosshead engine using a specific fuel.

The lubricating oil composition according to the third aspect of the present invention makes it possible to improve high-temperature anti-scuffing performance in a cylinder of a crosshead diesel engine.

According to the method of the fourth aspect of the present invention, a cylinder is lubricated using the lubricating oil composition according to the third aspect of the present invention, which makes it possible to improve high-temperature anti-scuffing performance in lubrication of a cylinder of a crosshead diesel engine.

DETAILED DESCRIPTION OF EMBODIMENTS

The present invention will be described hereinafter. Expression "A to B" concerning numeral values A and B means "no less than A and no more than B" unless otherwise specified. In such expression, if a unit is added only to the numeral value B, the unit is applied to the numeral value A as well. A word "or" means a logical sum unless otherwise specified.

<1. Lubricating Oil Composition (1)>

The lubricating oil composition according to the first aspect of the present invention (hereinafter may be simply referred to as "first lubricating oil composition") will be described. The first aspect of the present invention is a cylinder lubricating oil composition for a crosshead diesel engine, the composition having: a sulfated ash content of 2.0 to 5.5 mass %; a base number of 15 to 45 mgKOH/g; and an autoignition temperature of no less than 262° C.

(1.1 Lubricant Base Oil)

At least one selected from mineral oils and synthetic oils may be used as a base oil in the first lubricating oil composition.

Although not specifically limited, preferred examples of mineral oils generally include: oils obtained by desulfurizing, hydrocracking, and fractionally distilling atmospheric residue obtained by atmospheric distillation of crude oil, so that the oils have a desired viscosity grade; and oils obtained by solvent-dewaxing or catalytic-dewaxing, and optionally further solvent-extracting and hydrogenating if necessary, the atmospheric residue.

The following mineral oils may be used as well: petroleum wax isomerized lubricant base oils obtained by hydroisomerizing petroleum wax that is a side product in a dewaxing process in a base oil production process, which comprises further vacuum distilling the atmospheric distillation residue, fractionally distilling the resultant distillate so as to make the oil have a desired viscosity grade, and thereafter carrying out solvent refining, hydrorefining, etc., and then solvent dewaxing; GTL wax isomerized lubricant base oils produced by a process of isomerizing GTL WAX (gas to liquid wax) that is produced by a Fischer-Tropsch process, or the like; etc. The basic production processes of these wax isomerized lubricant base oils are the same as those in a method of producing hydrocracked base oils.

Any synthetic oil that is ordinarily used as a lubricant base oil may be used without particular limitations. Specific examples thereof include polybutene and hydrogenated product thereof; poly-α-olefins and hydrogenated product thereof, examples thereof including oligomers of 1-octene, 1-decene, dodecene, etc., or mixture thereof; diesters such as ditridecyl glutarate, bis(2-ethylhexyl) azipate, diisodecyl azipate, ditridecyl azipate, and bis(2-ethylhexyl) sebacate; polyol esters such as trimethylolpropane caprilate, trimethylolpropane pelargonate, pentaerythritol 2-ethylhexanoate, pentaerythritol plargonate, copolymers of dicarboxylic adds such as dibutyl maleate and $C_{2-30}$ α-olefins; aromatic synthetic oils such as alkylnaphthalene, alkylbenzene, and aromatic esters; and mixtures thereof.

The kinematic viscosity of the base oil at 100° C. is preferably no less than 10 $mm^2/s$, and more preferably no less than 13.5 $mm^2/s$; and preferably no more than 20 $mm^2/s$, and more preferably no more than 18.0 $mm^2/s$. The kinematic viscosity of the base oil at 100° C. of this lower limit or over leads to sufficient oil film formation at positions to be lubricated, which leads to good lubricity. The kinematic viscosity of the base oil at 100° C. of this upper limit or below leads to good low-temperature fluidity. In the present description, the kinematic viscosity at 100° C. means kinematic viscosity at 100° C. specified in ASTM D-445.

One preferred embodiment of the base oil is a mixed base oil of a base oil having a kinematic viscosity at 100° C. of 10 to 14 mm/s and a base oil having a kinematic viscosity at 100° C. of 20 to 40 $mm^2/s$.

The viscosity index of the base oil is preferably no less than 85, more preferably no less than 90, and especially preferably no less than 95. The viscosity index of the base oil of this lower limit or over makes it possible to keep the viscosity low at a low temperature, which leads to good startability. In the present description, the viscosity index means a viscosity index measured conforming to JIS K 2283-1993.

In the first lubricating oil composition, the base oil may be a Group I base oil in API categories (sulfur content: more than 0.03 mass % and/or saturated content: less than 90 mass %, viscosity index: 80 to 119), a Group II base oil (sulfur content: no more than 0.03 mass % and saturated content: no less than 90 mass %, viscosity index: 80 to 119), or a mixture of a Group I base oil and a Group II base oil. In this description, the saturated content means a saturated content measured by the method specified in the ASTM D 2007-93.

(1.2 (A) Ca Salicylate Detergent and/or Ca Phenate Detergent, Having a Metal Ratio of No More than 7)

The first lubricating oil composition preferably comprises a metallic detergent having the metal ratio of no more than 7 that is a Ca salicylate detergent, a Ca phenate detergent, or a mixture thereof (hereinafter may be simply referred to as "component (A)").

A Ca salicylate, or a basic salt or overbased salt thereof may be used as a Ca salicylate detergent. Examples of Ca salicylates include a compound represented by the following formula (1). One Ca salicylate may be used individually, or at least two Ca salicylates may be used in combination.

(1)

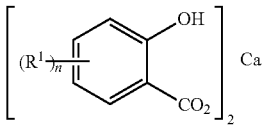

In the formula (1), $R^1$ each independently represents an alkyl or alkenyl group, and n represents 1 or 2. Preferably, n is 1. When n=2, two $R^1$'s may be combination of different groups.

A method for producing a Ca salicylate is not restricted, and a known method for producing monoalkylsalicylates, etc. may be used. For example, a Ca salicylate may be obtained by: making a calcium base such as an oxide and hydroxide of calcium react with a monoalkylsalicylic acid obtained by alkylating a phenol as a starting material with an olefin, and then carboxylating the resultant product with carbonic acid gas or the like, or with a monoalkylsalicylic acid obtained by alkylating a salicylic acid as a starting material with an equivalent of the olefin, or the like; or, converting the above monoalkylsalicylic acid or the like to an alkali metal salt such as a sodium salt and potassium salt, and then performing transmetallation with a calcium salt; or the like.

A method for obtaining a basic salt of a Ca salicylate is not restricted. For example, a Ca salicylate, and an excess calcium salt or calcium base (hydroxide or oxide of calcium) may be heated in the presence of water, to obtain a basic salt of a Ca salicylate.

A method for obtaining an overbased salt of a Ca salicylate is not restricted. For example, a Ca salicylate may be reacted with a base such as a hydroxide of calcium in the presence of carbonic acid gas, or boric acid or a borate, to obtain an overbased salt of a Ca salicylate.

Examples of Ca phanate detergents include: a calcium salt of a compound having a structure represented by the following formula (2), or a basic salt or overbased salt thereof. In the component (A), one Ca phenate may be used individually, or at least two Ca phenates may be used in combination.

(2)

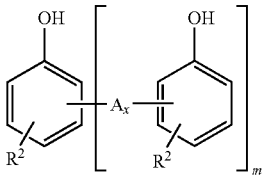

In the formula (2), $R^2$ represents a $C_{6-21}$ linear or branched chain, saturated or unsaturated alkyl or alkenyl group, m represents a polymerization degree, which is an integer of 1 to 10, A represents sulfide (—S—) group or methylene (—$CH_2$—) group, and x represents an integer of 1 to 3. $R^2$ may be combination of at least two different groups.

The carbon number of $R^2$ in the formula (2) is preferably 9 to 18, and more preferably 9 to 15. The carbon number of $R^2$ of this lower limit or more makes it possible to improve the solubility of a Ca phenate in the base oil. The carbon number of $R^2$ of this upper limit or less makes it easy to produce a Ca phenate, and makes it possible to improve thermal stability of a Ca phenate.

The polymerization degree m in the formula (2) is preferably 1 to 4. The polymerization degree m within this range makes it possible to improve the thermal stability of a Ca phenate.

The metal ratio of the component (A) is a value calculated according to the following formula. The metal ratio is no more than 7, preferably no more than 5.5, and more preferably no more than 4; and preferably no less than 1.3, more preferably no less than 1.5, and further preferably no less than 2.5.

the metal ratio of the component (*A*)=the Ca content in the component (*A*) (mol)/the Ca soap content in the component (*A*) (mol)

The metal ratio of the component (A) of this lower limit or over makes it possible to improve stability of additives in the lubricating oil composition. The metal ratio of the component (A) of this upper limit or below makes it possible to raise the autoignition temperature of the lubricating oil composition.

The content of the component (A) in the first lubricating oil composition may be such that the base number of the lubricating oil composition is within the range described later (for example, 15 to 45 mgKOH/g).

(1.3 (B) Ca Sulfonate Detergent Having Base Number of No Less than 10 mgKOH/g and Less than 60 mgKOH/g)

The first lubricating oil composition preferably comprises a Ca sulfonate detergent having a base number of no less than 10 mgKOH/g and less than 60 mgKOH/g (hereinafter may be simply referred to as "component (B)").

Generally, metallic detergents are obtained by reaction in diluents such as solvents and lubricant base oils. Therefore, metallic detergents are on the market as diluted in diluents such as lubricant base oils. In this description, the base number of a metallic detergent means a base number as containing the diluent.

Examples of the Ca sulfonate detergent include calcium salts of alkyl aromatic sulfonic acids obtained by sulfonation of alkylaromatics, and basic or overbased salts thereof. The weight-average molecular weight of the alkylaromatics is preferably 400 to 1500, and more preferably 700 to 1300.

Examples of alkyl aromatic sulfonic acids include what is called petroleum sulfonic acids and synthetic sulfonic acids. Examples of petroleum sulfonic acids here include sulfonated products of alkylaromatics of lubricant oil fractions derived from mineral oils, and what is called mahogany acid, which is a side product of white oils. Examples of synthetic sulfonic acids include sulfonated products of alkylbenzene having a linear or branched alkyl group, obtained by recovering side products in a manufacturing plant of alkylbenzene, which is raw material of detergents, or by alkylating benzene with a polyolefin. Another example of synthetic sulfonic acids is a sulfonated product of alkylnaphthalenes such as dinonylnaphthalene. Sulfonating agents used when sulfonating these alkylaromatics are not limited. For example, a fuming sulfuric acid or a sulfuric anhydride may be used as a sulfonating agent.

The content of the component (B) in the first lubricating oil composition is normally no less than 100 mass ppm, preferably no less than 125 mass ppm, and more preferably no less than 150 mass ppm; and normally no more than 1000 mass ppm, preferably no more than 750 mass ppm, and more preferably no more than 650 mass ppm, in terms of Ca on the basis of the total mass of the composition (100 mass %). The content of the component (B) of this lower limit or over makes it possible to more effectively suppress preignition. The content of the component (B) of this upper limit or below makes it possible to suppress increase of the ash content in the composition while obtaining the effect of suppressing preignition.

In order to make the content of the component (B) in the lubricating oil composition within this range, the incorporated amount of the component (B) in the lubricating oil composition may be normally no less than 0.4 mass % preferably no less than 0.5 mass %, and more preferably no less than 0.6 mass %; and normally no more than 4 mass %, preferably no more than 3 mass %, and more preferably no more than 2.5 mass %, on the basis of the total mass of the composition.

(1.4 (C) Ca Phenate Detergent Having Base Number of 55 to 200 mgKOH/g)

The first lubricating oil composition preferably comprises a Ca phenate detergent having a base number of 55 to 200 mgKOH/g (hereinafter may be simply referred to as "component (C)").

Examples of the Ca phenate detergent of the component (C) include: a calcium salt of a compound having a structure represented by the above formula (2), or a basic salt or overbased salt thereof. In the component (C), one Ca phenate may be used individually, or at least two Ca phenates may be used in combination.

The base number of the component (C) is 55 to 200 mgKOH/g, preferably no less than 60 mgKOH/g, and more preferably no less than 70 mgKOH/g; and preferably no more than 180 mgKOH/g, and more preferably no more than 160 mgKOH/g. The base number of the component (C) of this lower limit or more makes it possible to improve stability of additives in the lubricating oil composition. The base number of the component (C) of this upper limit or less makes it possible to improve the effect of suppression of preignition.

In order to make the base number of the component (C) within this range, the metal ratio of the component (C) may be normally no less than 1.00, preferably no less than 1.05, more preferably no less than 1.25, and further preferably no less than 1.75; and normally no more than 3.60, preferably no more than 3.20, and more preferably no more than 2.85.

The content of the component (C) in the first lubricating oil composition is normally no less than 200 mass ppm, and preferably no less than 300 mass ppm; and normally no more than 2000 mass ppm, preferably no more than 1500 mass ppm, and more preferably no more than 1350 mass ppm, in terms of Ca on the basis of the total mass of the composition. The content of the component (C) of this lower limit or more makes it possible to improve the effect of suppressing preignition. The content of the component (C) of this upper limit or less makes it possible to suppress increase of the ash content in the composition while obtaining the effect of suppressing preignition.

In order to make the content of the component (C) in the lubricating oil composition within this range, the incorporated amount of the component (C) in the lubricating oil composition may be normally no less than 0.4 mass %, preferably no less than 0.5 mass %, and more preferably no less than 0.5 mass %; and normally no more than 4 mass %, preferably no more than 3 mass %, and more preferably no more than 2.5 mass %.

(1.5 (D) Amine Antioxidant and/or Sulfur-Containing Compound)

The first lubricating oil composition preferably comprises an amine antioxidant and/or a sulfur-containing compound (hereinafter may be simple referred to as "component (D)"). In the first lubricating oil composition, any sulfur-containing compound falling under metallic detergents, zinc dithiophosphates, zinc dithiocarbamates, oil-soluble organic molybdenum compounds, or ashless dispersants shall not contribute to the content of the component (D).

Preferred examples of the component (D) include: alkylated diphenylamine, alkylated phenyl-α-naphthylamine, phenyl-α-naphthylamine, phenyl-β-naphthylamine, thiadiazole, disulfides, sulfurized fats, polysulfides, and sulfurized olefins. As the component (D), one may be used individually, or at least two may be used in combination.

The content of the component (D) in the first lubricating oil composition is normally no less than 0.10 mass %, preferably no less than 0.15 mass %, more preferably no less than 0.20 mass %, and further preferably no less than 0.5 mass %; and normally no more than 5 mass %, preferably no more than 3 mass %, and more preferably no more than 2 mass %, on the basis of the total mass of the composition. The content of the component (D) of this lower limit or more makes it possible to improve the effect of suppressing preignition. The content of the component (D) of this upper limit or less makes it possible to improve dissolution stability of additives in the lubricating oil composition while obtaining the effect of suppressing preignition.

(1.6 (E) ZnDTP or ZnDTC)

The first lubricating oil composition preferably comprises a zinc dithiophosphate (ZnDTP) or a zinc dithiocarbamate (ZnDTC) (hereinafter may be simply referred to as "component (E)").

A compound represented by the following formula (3) may be preferably used as the zinc dithiophosphate (ZnDTP):

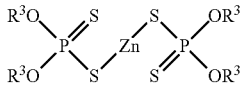

(3)

In the formula (3), $R^3$ each independently represents a $C_{1-24}$ hydrocarbon group, and may be combination of different groups. Preferred examples of $C_{1-24}$ hydrocarbon groups include $C_{1-24}$ linear or branched alkyl groups. The carbon number of $R^3$ is preferably no less than 3; and preferably no more than 12, and more preferably no more than 8. An alkyl group as $R^3$ is preferably a primary or secondary alkyl group, or combination thereof, and is to more preferably a primary alkyl group.

In one preferred embodiment, $R^3$ is a $C_{3-8}$ primary and/or secondary alkyl group, and more preferably a $C_{3-8}$ primary alkyl group.

A method for producing the zinc dithiophosphate is not restricted. For example, the zinc dithiophosphate may be prepared by a process including: reacting an alcohol having an alkyl group corresponding to $R^3$ with phosphorus pentasulfide to prepare dithiophosphoric acid; and neutralizing the dithiophosphoric acid with zinc oxide.

A compound represented by the following formula (4) may be preferably used as the zinc dithiocarbamate (ZnDTC):

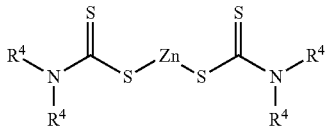

(4)

In the formula (4), $R^4$ each independently represents a $C_{1-24}$ hydrocarbon group, and may be combination of different groups. Preferred examples of $C_{1-24}$ hydrocarbon groups include $C_{1-24}$ linear or branched alkyl groups. The carbon number of $R^4$ is preferably no less than 3; and preferably no more than 12, and more preferably no more than 8. An alkyl group as $R^4$ is preferably a primary or secondary alkyl group, or combination thereof, and is more preferably a primary alkyl group.

In one preferred embodiment, $R^4$ is a $C_{3-8}$ primary and/or secondary alkyl group, and more preferably a $C_{3-8}$ primary alkyl group.

The content of the component (E) in the first lubricating oil composition is normally no less than 100 mass ppm, preferably no less than 150 mass ppm, and more preferably no less than 250 mass ppm; and normally no more than 700 mass ppm, preferably no more than 500 mass ppm, and more preferably no more than 400 mass ppm, in terms of Zn on the basis of the total mass of the composition. The content of the component (E) of this lower limit or over makes it possible to improve the effect of suppressing preignition. The content of the component (E) of this upper limit or below makes it possible to suppress deterioration of detergency due to acid components generated by thermal decomposition of the component (E).

(1.7 (F) Oil-Soluble Organic Molybdenum Compound)

The first lubricating oil composition preferably comprises an oil-soluble organic molybdenum compound (hereinafter may be simply referred to as "component (F)"). An oil-soluble organic molybdenum compound may be a sulfur-containing organic molybdenum compound such as molybdenum dithiophosphate (MoDTP) and molybdenum dithiocarbamate (MoDTC); a complex of a molybdenum compound (examples thereof include: molybdenum oxides such as molybdenum dioxide and molybdenum trioxide; molybdenum acids such as orthomolybdic acid, paramolybdic acid, and sulfurized (poly)molybdic acid; molybdic acid salts such as metal salts and ammonium salts of these molybdic acids; molybdenum sulfides such as molybdenum disulfide, molybdenum trisulfide, molybdenum pentasulfide, and molybdenum polysulfide; thiomolybdic acid; metal salts and amine salts of thiomolybdic acid; and molybdenum halides such as molybdenum chloride), and a sulfur-containing organic compound (examples thereof include: alkyl (thio)xanthate, thiadiazole, mercaptothiadiazole, thiocarbonate, tetrahydrocarbylthiuram disulfide, bis(di(thio)hydrocarbyldithiophosphonate) disulfide, organic (poly)sulfide, and sulfurized ester) or other organic compounds; or a complex of a sulfur-containing molybdenum compound such as the above described molybdenum sulfides and sulfurized molybdic acids, and alkenylsuccinimide, or the like.

An oil-soluble molybdenum compound which does not contain sulfur as a constituting element may be used as the oil-soluble organic molybdenum compound. Specific examples of an oil-soluble molybdenum compound which does not contain sulfur as a constituting element include molybdenum-amine complex, molybdenum-succinimide complex, molybdenum salt of organic acids, and molybdenum salt of alcohols.

Preferred examples of the component (F) include molybdenum dithiocarbamate (MoDTC), molybdenum dithiophosphate (MoDTP), molybdenum polyisobutenylsuccinimide complex, and dialkylamine salt of molybdic acids. One or at least two selected from them may be preferably used. Among them, MoDTC and/or MoDTP are/is preferable, and MoDTC is especially preferable.

For example, a compound represented by the following general formula (5) may be used as molybdenum dithiocarbamate:

(5)

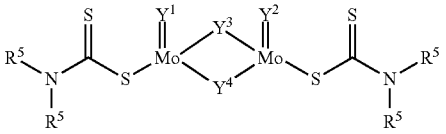

In the general formula (5), $R^5$ each independently represents a $C_{2-24}$ alkyl or $C_{6-24}$ (alkyl)aryl group, and preferably a $C_{4-13}$ alkyl or $C_{10-15}$ (alkyl)aryl group. $R^5$ may be combination of different groups. The alkyl group may be a primary, secondary, or tertiary alkyl group, and may be linear or branched. "(Alkyl)aryl group" means "aryl or alkylaryl group". In the alkylaryl group, the alkyl substituent may be in any position of the aromatic ring. $Y^1$ to $Y^4$ are each independently a sulfur atom or oxygen atom.

For example, a compound represented by the following general formula (6) may be used as molybdenum dithiophosphate:

(6)

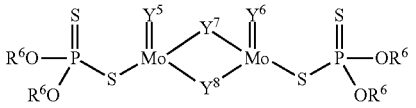

In the general formula (6), $R^6$ each independently represents a $C_{2-30}$ alkyl or $C_{6-18}$ (alkyl)aryl group, and may be combination of different groups. The carbon number of the alkyl group is preferably 5 to 18, and more preferably 5 to 12. The carbon number of the (alkyl)aryl group is preferably 10 to 15. $Y^5$ to $Y^8$ are each independently a sulfur atom or oxygen atom. The alkyl group may be a primary, secondary, or tertiary alkyl group, and may be linear or branched. In the alkylaryl group, the alkyl substituent may be in any position of the aromatic ring.

The content of the component (F) in the first lubricating oil composition is normally no less than 100 mass ppm, preferably no less than 400 mass ppm, more preferably no less than 600 mass ppm, and further preferably no less than 800 mass ppm; and normally no more than 2000 mass ppm, preferably no more than 1500 mass ppm, and more preferably no more than 1200 mass ppm, in terms of Mo on the basis of the total mass of the composition. The content of the component (F) of this lower limit or over makes it possible to effectively exhibit the effect of friction modification of an oil-soluble molybdenum compound. The content of the component (F) of this upper limit or under makes it possible to suppress the ash content in the lubricating oil composition, and makes it possible to improve the storage stability of the lubricating oil composition.

(1.8 (G) Ashless Dispersant)

The first lubricating oil composition preferably comprises an ashless dispersant (hereinafter may be simply referred to as "component (G)"). As the ashless dispersant, succinimide having at least one alkyl or alkenyl group in its molecule, or a boronated derivative thereof may be preferably used.

Examples of succinimide having at least one alkyl or alkenyl group in its molecule include compounds represented by the following formula (7) or (8):

(7)

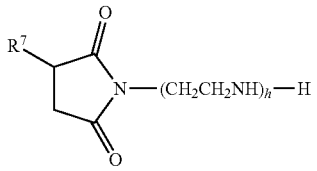

(8)

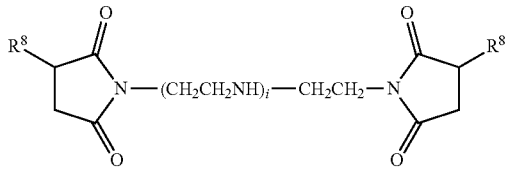

In the formula (7), $R^7$ represents a $C_{40-400}$ alkyl or alkenyl group, h is an integer of 1 to 5, which is preferably 2 to 4. The carbon number of $R^7$ is preferably no less than 60, and preferably no more than 350.

In the formula (8), $R^8$ each independently represents a $C_{40-400}$ alkyl or alkenyl group, and may be combination of different groups. $R^8$ is especially preferably a polybutenyl group. "i" represents an integer of 0 to 4, which is preferably 1 to 3. The carbon number of $R^8$ is preferably no less than 60, and preferably no more than 350.

Succinimide having at least one alkyl or alkenyl group in its molecule includes so-called monotype succinimide represented by the formula (7), where a succinic anhydride terminates only one end of a polyamine chain, and so-called bis-type succinimide represented by the formula (8), where succinic anhydrides terminate both ends of a polyamine chain. The lubricating oil composition of the present invention may contain either monotype or bis-type succinimide, and may contain both of them as a mixture. In the component (G), the main component is preferably bis-type succinimide. That is, the amount of bis-type succinimide (formula (8)) is preferably more than 50 mass %, more preferably no less than 70 mass %, further preferably no less than 80 mass %, and may be 100 mass %, on the basis of the total mass of the component (G) (100 mass %).

A method for producing succinimide having at least one alkyl or alkenyl group in its molecule is not limited. For example, such succinimide may be obtained by: reacting an alkyl succinic acid or an alkenyl succinic acid obtained by reacting a compound having a $C_{40}$-$C_{400}$ alkyl or alkenyl group with maleic anhydride at 100 to 200° C., with a polyamine. Here, examples of a polyamine include diethylenetriamine, triethylenetetramine, tetraethylenepentamine, and pentaethylenehexamine.

Examples of boronated derivatives of succinimide having at least one alkyl or alkenyl group in its molecule include boron-modified products where a part or all of the residual amino and/or imino groups are neutralized or amidated by making boric acid react with the above described succinimide having at least one alkyl or alkenyl group in its molecule.

The content of the component (G) in the first lubricating oil composition is normally no less than 0.01 mass %, preferably no less than 0.02 mass %, and more preferably no less than 0.025 mass %; and normally no more than 0.4 mass %, preferably no more than 0.2 mass %, and more preferably no more than 0.1 mass %, in terms of nitrogen on the basis of the total mass of the composition. When a boron-containing ashless dispersant is used as the component (G), the mass ratio of the boron content to the nitrogen content thereof (B/N ratio) is preferably 0.2 to 1, and more preferably 0.25 to 05. As the B/N ratio is higher, it is easier to improve anti-wear properties and anti-seizure performance. The B/N ratio of no more than 1 makes it possible to improve stability. When a boron-containing ashless dispersant is used as the component (G), the content of the component (G) as boron is preferably 0.001 to 0.1 mass %, more preferably 0.005 to 0.05 mass %, and especially preferably 0.01 to 0.04 mass %, in terms of boron on the basis of the total mass of the composition.

The number average molecular weight (Mn) of the component (G) is measured by removing a diluent from the sample by rubber membrane dialysis, and analyzing the resultant residue by gel permeation chromatography (GPC).

Procedures of the rubber membrane dialysis are as follows:

(i) putting about 5 g of the sample in a rubber membrane;

(ii) closing the rubber membrane with a string, and putting the rubber membrane in a cylindrical filter paper;

(iii) placing the cylindrical filter paper in a Soxhlet extraction apparatus;

(iv) placing petroleum ether (100 mL) in a flat-bottom flask, and attaching the Soxhlet extraction apparatus thereon;

(v) warming the flat-bottom flask in a water bath (70° C.), while cooling the Soxhlet extraction apparatus with a condenser attached thereon;

(vi) refluxing for 2 days;

(vii) transferring a dialysis residue in the rubber membrane to a beaker, washing the rubber membrane of materials sticking to the membrane with petroleum ether, and adding the washings to the beaker; and removing the petroleum ether in the beaker by evaporation by heating in a water bath, to obtain the rubber membrane residue; and (viii) removing the petroleum ether in the flat-bottom flask by evaporation by heating in a water bath, to obtain the rubber membrane dialysis residue.

Analysis conditions of GPC are as follows:

apparatus: Waters Alliance 2695 column: GMHHR-M by Tosoh Corporation eluent: tetrahydrofuran concentration of the sample diluted with a solvent: 1 mass % (solvent: tetrahydrofuran)

temperature: 23° C.

flow rate: 1 mL/min sample amount: 100 μL detector: differential refractometer detector (RI)

molecular weight: in terms of polystyrene

The effective concentration of the component (G), the ashless dispersant, is calculated from the result of the rubber membrane dialysis. That is, the effective concentration is calculated as a ratio of the mass of the residue in the rubber membrane (unit: g) to the mass of the sample initially taken (in the step (i)) (unit: g).

Preferably, the component (G) is incorporated in the lubricating oil composition such that a product of the number average molecular weight (Mn) of the component (G) and the incorporated amount and the effective concentration, i.e. a product of the number average molecular weight and the concentration of the component (G) in the lubricating oil composition, is 9000 or more. This product is preferably no less than 10000, more preferably no less than 12000, further preferably no less than 15000, and most preferably no less than 20000; and preferably no more than 50000. The product of this lower limit or over makes ash deposits of the cylinder lubricating oil which accumulate at a piston top-land softened, which leads to easy breakage of the deposits, which makes it possible to suppress accumulation of the deposits at the piston top-land. The product of this upper limit or below makes it possible to sufficiently secure the fluidity of the lubricating oil composition, and to suppress increase of the deposits.

The number average molecular weight (Mn) of the component (G) is preferably no less than 2500, more preferably no less than 3000, further preferably no less than 4000, and especially preferably no less than 5000; and preferably no more than 10000. The number average molecular weight of the ashless dispersant of this lower limit or over makes it easy to suppress accumulation of the deposits, and is advantageous in view of suppression of friction. The number average molecular weight of the ashless dispersant of this upper limit or below makes it possible to sufficiently secure the fluidity of the lubricating oil composition, and to suppress increase of the deposits.

The effective concentration of the (G) ashless dispersant is not limited, but preferably 0.30 to 0.70. The concentration of the (G) ashless dispersant in the lubricating oil composition (product of the incorporated amount and the effective concentration) is not limited, but is preferably 0.9 to 14 mass % on the basis of the total mass of the lubricating oil composition.

(1.9 Other Additives)

The first lubricating oil composition may further comprise any additive that is generally used for lubricating oils according to purposes thereof. Examples of such an additive include antioxidants other than the component (D), extreme-pressure agents other than the components (D), (E), and (F), defoaming agents, pour point depressants, and metal deactivators other than the component (D).

Examples of antioxidants other than the component (D) include ashless antioxidants such as phenol-based antioxidants, and metal-based antioxidants. When the first lubricating oil composition contains an antioxidant other than the component (D), the content thereof is preferably no less than 0.2 mass %, more preferably no less than 0.5 mass %; and preferably no more than 2.0 mass %, and more probably no more than 1.0 mass %, on the basis of the total mass of the composition.

Examples of extreme-pressure agents other than the components (D), (E), and (F) include phosphorus-based extreme pressure agents. Specific examples thereof include phosphorous esters, phosphate esters, amine salts thereof, metal salts thereof, and derivatives thereof. When the first lubricating oil composition contains an extreme-pressure agent, the content thereof is not limited, but normally 0.01 to 5 mass % on the basis of the total mass of the composition.

Examples of defoaming agents include: silicone oils, alkenylsuccinic acid derivatives, esters of a polyhydroxy aliphatic alcohol and a long chain fatty acid, methyl salicylate, o-hydroxybenzyl alcohol, aluminum stearate, potassium oleate, N-dialkyl-allylamine nitro amino alkanols, aromatic amine salts of isoamyl octyl phosphate, alkyl alkylene diphosphate, metal derivatives of thioethers, metal derivatives of disulfides, fluorinated aliphatic hydrocarbons, triethylsilane, dichlorosilane, alkyl phenyl polyethyleneglycol ether sulfide, fluoroalkyl ethers, etc. When the first lubricating oil composition contains a defoaming agent, the content thereof is normally 0.0005 to 1 mass % on the basis of the total mass of the composition. When the defoaming agent contains silicon, the content thereof is such that the Si content in the lubricating oil composition is preferably 5 to 50 mass ppm.

Examples of pour point depressants include polymethacrylate polymers compatible with the lubricant base oil used. When the first lubricating oil composition contains a pour point depressant, the content thereof is usually 0.005 to 5 mass % on the basis of the total mass of the composition.

A known metal deactivator that is used in lubricating oils and is other than the component (D) may be used as a metal deactivator other than the component (D) without any specific restriction. Examples thereof include imidazoline, pyrimidine derivatives, and benzotriazole or derivatives thereof. When the first lubricating oil composition contains a metal deactivator, the content thereof is normally 0.005 to 1 mass % on the basis of the total mass of the composition.

(1.10 Lubricating Oil Composition)

The base number of the first lubricating oil composition is 15 to 45 mgKOH/g, preferably no less than 20 mgKOH/g, and more preferably no less than 30 mgKOH/g; and preferably less than 35 mgKOH/g. In this description, the base number means a base number measured by the perchloric acid method conforming to JIS K2501.

The base number of the lubricating oil composition of less than 15 mgKOH/g may lead to insufficient detergency. The base number of the lubricating oil composition of over 45 mgKOH/g may lead to accumulation of excess base components on a piston, to inhibit oil film formation, which causes bore polishing and scuffing.

The sulfated ash content of the first lubricating oil composition is 2.0 to 5.5 mass %, preferably no more than 5.2 mass %, and more preferably no more than 5.0 mass %. The sulfated ash content is measured conforming to JIS K2272.

The autoignition temperature of the first lubricating oil composition is no less than 262° C., preferably no less than 264° C., more preferably no less than 266° C., and especially preferably no less than 270° C. The autoignition temperature of lower than 262° C. leads to more frequent occurrence of preignition. It is believed that the rise of the autoignition temperature of the cylinder lubricating oil composition from 260° C. to 270° C. lowers the frequency of preignition to about 1/7. Thus, it is predicted that difference of autoignition temperature just by 1° C. has an important effect in this temperature range. The upper limit of the autoignition temperature is not limited, but normally no more than 300° C.

The autoignition temperature of the lubricating oil composition is measured by means of pressurized differential scanning calorimetry (PDSC), as a temperature at which the sample begins to generate heat when heating the sample in an oxygen atmosphere (pressure: 1.0 MPa) from 25° C. to 500° C. at a heating rate of 10° C./min. For example, Q2000DSC manufactured by TA Instruments may be preferably used as a PDSC apparatus, and the amount of the sample may be 3 mg.

The kinematic viscosity of the first lubricating oil composition at 100° C. is normally no less than 12.5 $mm^2/s$ and less than 26.1 $mm^2/s$, preferably no less than 16.3 $mm^2/s$, and more preferably no less than 18.0 $mm^2/s$; and preferably less than 21.9 $mm^2/s$, and more preferably less than 21.0 $mm^2/s$.

The kinematic viscosity of the lubricating oil composition at 100° C. of no less than 12.5 $mm^2/s$ makes it possible to improve the ability of oil film formation, which makes it easy to suppress seizure of rings and a liner. The kinematic viscosity of the lubricating oil composition at 100° C. of less than 26.1 $mm^2/s$ makes it easy to improve startability.

(1.11 Use)

The first lubricating oil composition can be preferably used for lubricating a cylinder of a crosshead diesel engine using a specific fuel. Specific fuels are preferably fuels having flash points of no more than 15° C.; among them, preferably fuels having $C_{1-4}$ hydrocarbons; and among them, more preferably, fuels comprising methane, ethane, ethylene, propane, butane, methanol, ethanol, dimethyl ether, or combination thereof. It makes suppression of preignition possible to use the first lubricating oil composition for lubricating a cylinder of a crosshead diesel engine using such a specific fuel.

<2. Method for Lubricating Cylinder>

The method for lubricating a cylinder according to the second aspect of the present invention will be described.

The method for lubricating a cylinder of a crosshead diesel engine according to the second aspect of the present invention comprises the steps of: (a) operating a crosshead diesel engine using a fuel (specific fuel) having a flash point of no more than 15° C.; and (b) supplying the first lubricating oil composition to the cylinder of a crosshead diesel engine. Here, the fuel in the step (a) is preferably a fuel having a $C_{1-4}$ hydrocarbon; and more preferably, a fuel comprising methane, ethane, ethylene, propane, butane, methanol, ethanol, dimethyl ether, or combination thereof. According to the method for lubricating a cylinder of the second aspect of the present invention, the cylinder is lubricated using the first lubricating oil composition in the step (b), which makes it possible to suppress preignition in the step (a).

<3. Lubricating Oil Composition (2)>

A lubricating oil composition according to the third aspect of the present invention (hereinafter may be simply referred to as "second lubricating oil composition") will be described. The third aspect of the present invention is a cylinder lubricating oil composition for a crosshead diesel engine, comprising: a lubricant base oil; (B) a Ca sulfonate detergent having a base number of no less than 10 mgKOH/g and less than 60 mgKOH/g; (C) a Ca phenate detergent having a base number of 55 to 200 mgKOH/g; (D') an amine antioxidant; and (E') a zinc dithiophosphate, wherein the composition has a base number of no less than 15 mgKOH/g and less than 120 mgKOH/g.

(3.1 Lubricant Base Oil)

The same base oil as the lubricant base oil described above concerning the first lubricating oil composition may be used as the base oil in the second lubricating oil composition, which has the same preferred features as described above as well.

The kinematic viscosity of the base oil at 100° C. in the second lubricating oil composition is preferably no less than 10 $mm^2/s$, and more preferably no less than 14.0 $mm^2/s$; and preferably no more than 20 $mm^2/s$, and more preferably no more than 18.0 $mm^2/s$. The kinematic viscosity of the base oil at 100° C. of this lower limit or over makes it possible to form sufficient oil film at positions to be lubricated, which leads to good lubricity. The kinematic viscosity of the base oil at 100° C. of this upper limit or under makes it possible to obtain good low-temperature fluidity.

The saturated content of the base oil is preferably no less than 50 mass %, and more preferably no less than 55 mass %; and preferably less than 90 mass %, and more preferably less than 75 mass %. The saturated content of the base oil of this lower limit or over makes it possible to improve the oxidation stability of the lubricating oil composition. The saturated content of the base oil of this upper limit or below makes it possible to improve solubility of asphaltene and deterioration products, and thus makes it possible to improve detergency. In this description, the saturated content means a saturated content measured by the method specified in ASTM D 2007-93.

(3.2 (B) Ca Sulfonate Detergent Having Base Number of No Less than 10 mgKOH/g and Less than 60 mgKOH/g)

The second lubricating oil composition comprises a Ca sulfonate detergent having a base number of no less than 10 mgKOH/g and less than 60 mgKOH/g (hereinafter may simply referred to as "component (B)"). The same Ca sulfonate detergent as the component (B) described above concerning the first lubricating oil composition may be used as the component (B) in the second lubricating oil composition, which has the same preferred features as described above as well.

The content of the component (B) in the second lubricating oil composition is normally no less than 100 mass ppm, preferably no less than 125 mass ppm, and more preferably no less than 150 mass ppm; and normally no more than 1000 mass ppm, preferably no more than 750 mass ppm, and more preferably no more than 650 mass ppm, in terms of Ca on the basis of the total mass of the composition (100 mass %). The content of the component (B) of this lower limit or over makes it possible to more effectively suppress scuffing. The content of the component (B) of this upper limit or below makes it possible to suppress increase of the ash content in the composition while obtaining the effect of suppressing scuffing.

(3.3 (C) Ca Phenate Detergent Having Base Number of 55 to 200 mgKOH/g)

The second lubricating oil composition comprises a Ca phenate detergent having a base number of 55 to 200 mgKOH/g (hereinafter may be simply referred to as "component (C)"). The same Ca phenate detergent as the component (C) described above concerning the first lubricating oil composition may be used as the component (C) in the second lubricating oil composition, which has the same preferred features as described above as well.

The base number of the component (C) in the second lubricating oil composition is 55 to 200 mgKOH/g, preferably no less than 60 mgKOH/g, and more preferably no less than 70 mgKOH/g; and preferably no more than 180 mgKOH/g, and more preferably no more than 160 mgKOH/g. The base number of the component (C) of this lower limit or more makes it possible to improve stability of additives in the lubricating oil composition. The base number of the component (C) of this upper limit or less makes it possible to improve the effect of suppressing scuffing.

The content of the component (C) in the second lubricating oil composition is normally no less than 100 mass ppm, preferably no less than 200 mass ppm, and more preferably no less than 300 mass ppm; and normally no more than 2000 mass ppm, preferably no more than 1500 mass ppm, more preferably no more than 1350 mass ppm, and further preferably no more than 1200 mass ppm, in terms of Ca on the basis of the total mass of the composition. The content of the component (C) of this lower limit or more makes it possible to improve the effect of suppression of scuffing. The content of the component (C) of this upper limit or less makes it possible to suppress increase of the ash content in the composition while obtaining the effect of suppressing scuffing.

(3.4 (D') Amine Antioxidant)

The second lubricating oil composition comprises an amine antioxidant (hereinafter may be simply referred to as "component (D')").

Preferred examples of the amine antioxidant in the second lubricating oil composition include alkylated diphenylamine, alkylated phenyl-α-naphthylamine, phenyl-α-naphthylamine, phenyl-βnaphthylamine, and phenothiazine. Among them, alkylated diphenylamine, alkylated phenyl-α-naphthylamine, phenyl-α-naphthylamine, or phenyl-β-naphthylamine may be preferably used. One amine antioxidant may be used alone, or at least two amine antioxidants may be used in combination.

The content of the component (D') in the second lubricating oil composition is normally no less than 0.10 mass %, preferably no less than 0.15 mass %, more preferably no less than 0.20 mass %, and further preferably no less than 0.5 mass %; and normally no more than 5 mass %, preferably no more than 3 mass %, and more preferably no more than 2 mass %, on the basis of the total mass of the composition. The content of the component (D') of this lower limit or more makes it possible to improve the effect of suppression of scuffing. The content of the component (D') of this upper limit or less makes it possible to improve dissolution stability of additives in the lubricating oil composition while obtaining the effect of suppressing scuffing.

(3.5 (E') ZnDTP)

The second lubricating oil composition comprises a zinc dithiophosphate (ZnDTP) (hereinafter may be simply referred to as "component (E')").

A compound represented by the general formula (3) described above concerning the first lubricating oil composition may be preferably used as the zinc dithiophosphate (ZnDTP) in the second lubricating oil composition, which has the same preferred features as described above as well.

The content of the component (E') in the second lubricating oil composition is normally no less than 100 mass ppm, preferably no less than 150 mass ppm, and more preferably no less than 250 mass ppm; and normally no more than 700 mass ppm, preferably no more than 500 mass ppm, and more preferably no more than 400 mass ppm, in terms of P (phosphorus) on the basis of the total mass of the composition. The content of the component (E') of this lower limit or over makes it possible to improve the effect of suppression of scuffing. The content of the component (E') of this upper limit or below makes it possible to suppress deterioration of detergency due to acid components generated by thermal decomposition of the component (E').

(3.6 (G) Ashless Dispersant)

The second lubricating oil composition may comprise an ashless dispersant (hereinafter may be simply referred to as "component (G)"). The same ashless dispersant as the component (G) described above concerning the first lubricating oil composition may be used as the ashless dispersant in the second lubricating oil composition, which has the same preferred features as described above as well.

In the formula (7), the weight average molecular weight Mw of $R^7$ is preferably 1000 to 5000. In the formula (8), the weight average molecular weight Mw of $R^8$ is preferably 1000 to 5000.

The content of the component (G) in the second lubricating oil composition is normally no less than 0.01 mass %, preferably no less than 0.02 mass %, and more preferably no less than 0.025 mass %; and normally no more than 0.4 mass %, preferably no more than 02 mass %, and more preferably no more than 0.1 mass %, in terms of nitrogen on the basis of the total mass of the composition. When a boron-containing ashless dispersant is used as the component (G), the mass ratio of the boron content to the nitrogen content thereof (B/N ratio) is preferably 0.2 to 1, and more preferably 0.25 to 0.5. As the B/N ratio is higher, it is easier to improve anti-wear properties and anti-seizure performance. The B/N ratio of no more than 1 makes it possible to improve stability. When a boron-containing ashless dispersant is used as the component (G), the content of the component (G) as boron is preferably 0.001 to 0.1 mass %, more preferably 0.005 to 0.05 mass %, and especially 0.01 to 0.04 mass %, in terms of boron on the basis of the total mass of the composition.

(3.7 (H) Metallic Detergent)

The second lubricating oil composition preferably comprises a metallic detergent other than the components (B) and (C) (hereinafter may be simply referred to as "component (H)"). The component (H) is preferably an alkaline earth metal detergent, and preferably at least one selected from a Ca sulfonate detergent, a Ca phenate detergent, and a Ca salicylate detergent.

A Ca sulfonate detergent that does not fall under the component (B) may be used as a Ca sulfonate detergent of the component (H).

A Ca phenate represented by the general formula (2), and not falling under the component (C) may be preferably used as a Ca phenate detergent of the component (H).

A Ca salicylate detergent, or a base salt or overbased salt thereof may be used as a Ca salicylate detergent of the component (H). A Ca salicylate may be a compound represented by the general formula (1) described above concerning the first lubricating oil composition. One Ca salicylate may be used alone, or at least two Ca salicylates may be used in combination.

The base number of the component (H) is normally no less than 60 mgKOH/g, and preferably no less than 100 mgKOH/g; and normally no more than 500 mgKOH/g, and preferably no more than 450 mgKOH/g. The base number of the component (H) of this lower limit or more makes it possible to improve acid neutralization. The base number of the component (H) of this upper limit or less makes it possible to improve detergency.

The content of the component (H) in the second lubricating oil composition may be such that the base number of the lubricating oil composition is within the range described later.

(3.8 Other Additives)

The second lubricating oil composition may further comprise any additive that is generally used for lubricating oils according to purposes thereof. Examples of such an additive include antioxidants other than the component (D'), extreme-pressure agents other than the component (E'), defoaming agents, pour point depressants, and metal deactivators.

Examples of antioxidants other than the component (D') include ashless antioxidants such as phenol-based antioxidants, and metal-based antioxidants. When the second lubricating oil composition contains an antioxidant other than the component (D'), the content thereof is preferably no less than 0.2 mass %, more preferably no less than 0.5 mass %; and preferably no more than 2.0 mass %, and more probably no more than 1.0 mass %, on the basis of the total mass of the composition.

Examples of extreme-pressure agents other than the component (E') include sulfur-based, phosphorus-based, and sulfur-phosphorus-based extreme pressure agents. Specific examples thereof include phosphorous esters, thiophosphorous esters, dithiophosphorous esters, trithiophosphorous esters, phosphate esters, thiophosphate esters, dithiophosphate esters, trithiophosphate esters, amine salts thereof, metal salts thereof, derivatives thereof, dithiocarbamate, zinc dithiocarbamate, molybdenum dithiocarbamate, disulfides, polysulfides, sulfurized olefins, and sulfurized fats. When the second lubricating oil composition contains an extreme-pressure agent, the content thereof is not limited, but normally 0.01 to 5 mass % on the basis of the total mass of the composition.

The same defoaming agent as described above concerning the first lubricating oil composition may be used as a defoaming agent. When the second lubricating oil composition contains a defoaming agent, the content thereof is normally 0.0005 to 1 mass % on the basis of the total mass of the composition. When the defoaming agent contains silicon, the content thereof is such that the Si content in the lubricating oil composition is 5 to 50 mass ppm.

Examples of pour point depressants include polymethacrylate polymers compatible with the lubricant base oil used. When the second lubricating oil composition contains a pour point depressant, the content thereof is usually 0.005 to 5 mass % on the basis of the total mass of the composition.

Examples of metal deactivators include imidazoline, pyrimidine derivatives, alkylthiadiazole, mercaptobenzothiazole, benzotriazole or derivatives thereof, 1,3,4-thiadiazole polysulfide, 1,3,4-thiadiazolyl-2,5-bisdialkyldithiocarbamate, 2-(alkyldithio)benzimidazole, and β-(o-carboxybenzylthio)propionitrile. When the second lubricating oil composition contains a metal deactivator, the content thereof is normally 0.005 to 1 mass % on the basis of the total mass of the composition.

(3.9 Lubricating Oil Composition)

The base number of the second lubricating oil composition is no less than 15 mgKOH/g and less than 120 mgKOH/g, preferably no less than 20 mgKOH/g, more preferably no less than 30 mgKOH/g, and further preferably no less than 40 mgKOH/g; and preferably less than 120 mgKOH/g, and more preferably less than 105 mgKOH/g.

The base number of the lubricating oil composition of less than 15 mgKOH/g may lead to insufficient detergency. The base number of the lubricating oil composition of no less than 120 mgKOH/g may lead to accumulation of excess base components on a piston, to inhibit oil film formation, which causes bore polishing and scuffing.

The kinematic viscosity of the second lubricating oil composition at 100° C. is normally no less than 12.5 $mm^2/s$ and less than 26.1 $mm^2/s$, preferably no less than 16.3 $mm^2/s$, and more preferably no less than 18.0 $mm^2/s$; and preferably less than 21.9 $mm^2/s$, and more preferably less than 21.0 $mm^2/s$.

The kinematic viscosity of the lubricating oil composition at 100° C. of no less than 12.5 $mm^2/s$ makes it possible to improve the ability of oil film formation, which makes it easy to suppress seizure of rings and a linear. The kinematic viscosity of the lubricating oil composition at 100° C. of less than 26.1 $mm^2/s$ easily leads to good startability.

<4. Method for Improving High-Temperature Anti-Scuffing Performance of Crosshead Diesel Engine>

The method for improving high-temperature anti-scuffing performance of a crosshead diesel engine according to the fourth aspect of the present invention comprises the step of: supplying the second lubricating oil composition to a cylinder of a crosshead diesel engine. The step (a) can be carried out using a lubricating oil supply mechanism which the crosshead engine comprises. Normally, the step (a) is carried out while operating the crosshead engine.

EXAMPLES

Hereinafter the present invention will be more specifically described based on Examples and Comparative Examples. The present invention is not limited to these examples.

First Lubricating Oil Composition: Examples 1 to 19 and Comparative Examples 1 to 14

Lubricating oil compositions of formulations shown in Tables 1 to 3 were prepared. In Tables 1 to 3, "in mass %" represents the content (unit: mass %) on the basis of the mass of the total base oils, "mass %" represents the content on the basis of the total mass of the composition (unit: mass %), and "mass ppm" represents the content on the basis of the total mass of the composition (unit: mass ppm).

(Base Oil)

Base oil 1: Group I base oil, solvent-refined mineral oil, 500N, kinematic viscosity at 100° C.: 10.8 $mm^2/s$, sulfur content: 0.6 mass %, viscosity index: 97

Base oil 2: Group I base oil, solvent-refined mineral oil, ISO460, kinematic viscosity at 100° C.: 31.7 $mm^2/s$, sulfur content: 0.5 mass %, viscosity index: 96

Base oil 3: Group II base oil, kinematic viscosity at 100° C.: 10.7 $mm^2/s$, sulfur content: 0.01 mass %, viscosity index: 108

Base oil 4: Group II base oil, kinematic viscosity at 100° C.: 29.4 $mm^2/s$, sulfur content: 0.004 mass %, viscosity index: 104

(Commercially Available Cylinder Oil)

Commercially available cylinder oil A: cylinder oil for low-speed marine diesel engines using a fuel having a sulfur content of 0.1 mass % or less, base number: 17 mgKOH/g, SAE 50

Commercially available cylinder oil B: cylinder oil for low-speed marine diesel engines using a fuel having a sulfur content of 0.1 mass % or less, base number: 25 mgKOH/g, SAE 50

Commercially available cylinder oil C: cylinder oil for low-speed marine diesel engines using a fuel having a sulfur content of 1.0 to 3.5 mass %, base number: 70 mgKOH/g, SAE 50

(Component (A))

A-1: Ca phenate, base number 255 mgKOH/g, Ca content: 9.25 mass %, metal ratio: 4.6, diluent oil content: 38 mass %

A-2: Ca phenate, base number: 145 mgKOH/g, Ca content: 5.3 mass %, metal ratio: 2.7, diluent oil content: 42 mass %

A-3: Ca salicylate, base number: 225 mgKOH/g, Ca content: 8.0 mass %, metal ratio: 3.2, diluent oil content: 35 mass %

A-4: Ca salicylate, base number: 230 mgKOH/g, Ca content: 8.1 mass %, metal ratio: 4.5, diluent oil content: 30 mass %

(Component (B))

B-1: Ca sulfonate, base number: 15 mgKOH/g, Ca content: 2.5 mass %, diluent oil content: 55 mass %

(Component (C))

C-1: Ca phenate, base number: 70 mgKOH/g, Ca content: 2.4 mass %, metal ratio: 1.3, diluent oil content: 55 mass %

C-2: Ca phenate, base number 145 mgKOH/g, Ca content: 5.3 mass %, metal ratio: 2.7, diluent oil content: 42 mass %

(Component (D))

D-1: alkylated diphenylamine

D-2: alkyldithiothiadiazole, sulfur content: 36 mass %

(Component (E))

E-1: ZnDTP, $R^3$=2-ethylhexyl group in the general formula (3), Zn content: 6.9 mass %

E-2: ZnDTC, $R^4$=pentyl group in the general formula (4), Zn content: 6.2 mass %

(Component (F))

F-1: MoDTC, Mo content: 10.0 mass %

F-2: MoDTP, Mo content: 8.4 mass %

F-3: Mo-polyisobutenylsuccinimide complex, Mo content: 1.5 mass %

F-4: dialkylamine salt of molybdic acids, Mo content: 10.0 mass %

F-5: Mo-ester amide complex, Mo content: 8.0 mass %

(Component (G))

G-1: polybutenyl succinimide, Mn=7630, effective concentration: 45 mass %, nitrogen content: 0.87 mass %

(Other Additives)

A'-1: Ca salicylate, base number: 320 mgKOH/g, Ca content: 11.4 mass %, metal ratio: 7.5

A'-2: Ca sulfonate, base number: 320 mgKOH/g, Ca content: 12.5 mass %, metal ratio: 11

D'-1: phenothiazine

D'-2: phenol-based antioxidant (Hot Tube Test)

High-temperature detergency of the lubricating oil compositions was evaluated by a hot tube test. The test was carried out at 330° C. and at 335° C. The results are shown in Tables 1 to 3. Ratings are 0 to 10. Higher ratings mean better high-temperature detergency. In Tables 1 to 3, "choked" as the rating of the hot tube test means that a tube was choked with deposits in the test, which made it impossible to further continue the test.

(Autoignition Temperature)

Autoignition temperature of the lubricating oil compositions was measured, to evaluate the ability of suppressing preignition. The autoignition temperature was measured by means of PDSC (Q2000DSC manufactured by TA Instruments), as a temperature at which the sample (3 mg) began to generate heat when heating the sample in an oxygen atmosphere (pressure: 1.0 MPa) from 25° C. to 500° C. at a heating rate of 10° C./min. The results are shown in Tables 1 to 3. Higher autoignition temperature means a better ability of suppressing preignition.

TABLE 1

| | | | Examples | | | | | | | | | | | |
|---|---|---|---|---|---|---|---|---|---|---|---|---|---|---|
| | | | 1 | 2 | 3 | 4 | 5 | 6 | 7 | 8 | 9 | 10 | 11 | 12 |
| Base oil 1 | Group I, 500N | inmass % | 62 | 62 | 62 | 62 | 62 | 62 | 62 | 62 | 62 | — | 62 | 67 |
| Base oil 2 | Group I, ISO460 | inmass % | 38 | 38 | 38 | 38 | 38 | 38 | 38 | 38 | 38 | — | 38 | 33 |
| Base oil 3 | Group II, 500N | inmass % | — | — | — | — | — | — | — | — | — | 58 | — | — |
| Base oil 4 | Group II, ISO380 | inmass % | — | — | — | — | — | — | — | — | — | 42 | — | — |
| A-1 | Ca phenate | mass % | 10.8 | — | — | — | — | — | — | — | — | — | — | — |
| A-2 | Ca phenate | mass % | — | 18 | — | — | — | — | — | — | — | — | — | — |
| A-3 | Ca salicylate | mass % | — | — | 5.4 | 8 | 8 | 12.2 | 12.2 | 12.2 | 12.2 | 12.2 | — | 16.6 |
| A-4 | Ca salicylate | mass % | — | — | — | — | — | — | — | — | — | — | 11.7 | — |
| B-1 | Neutral Ca sulfonate | mass % | 2 | 2 | 2 | 2 | 2 | 1 | 2 | 2 | 2 | 2 | 2 | 2 |
| C-1 | Neutral Ca phenate | mass % | — | — | — | — | — | — | — | 2 | — | — | — | — |
| C-2 | Basic Ca phenate | mass % | 2 | 2 | 2 | 2 | 2 | 1 | 2 | — | 2 | 2 | 2 | 2 |
| D-1 | Amine antioxidant | mass % | 0.5 | 0.5 | 1 | 0.75 | 0.75 | 0.3 | 0.5 | 0.5 | — | 0.5 | 0.5 | 0.5 |
| D-2 | Thiadiazole | mass % | — | — | — | — | — | — | — | — | 1 | — | — | — |
| E-1 | ZnDTP | mass % | 0.4 | 0.4 | 0.4 | 0.4 | — | 0.2 | 0.4 | 0.4 | 0.4 | 0.4 | 0.4 | 0.4 |
| E-2 | ZnDTC | mass % | — | — | — | — | 0.48 | — | — | — | — | — | — | — |
| G-1 | Ashless dispersant | mass % | 3 | 3 | 3 | 3 | 3 | — | 3 | 3 | 3 | 3 | 3 | 3 |
| Base number | | mgKOH/g | 30 | 30 | 15 | 20 | 20 | 30 | 30 | 30 | 30 | 30 | 30 | 40 |
| Sulfated ash content | | mass % | 3.89 | 3.89 | 2.08 | 2.70 | 2.70 | 3.35 | 3.89 | 3.89 | 3.89 | 3.89 | 3.89 | 5.13 |
| Ca content from Component (A) | | mass % | 1.00 | 0.95 | 0.43 | 0.64 | 0.64 | 0.98 | 0.98 | 0.98 | 0.98 | 0.98 | 0.95 | 1.33 |
| Ca content from Component (B) | | mass ppm | 500 | 500 | 500 | 500 | 500 | 250 | 500 | 500 | 500 | 500 | 500 | 500 |
| Ca content from Component (C) | | mass ppm | 1060 | 1060 | 1060 | 1060 | 1060 | 530 | 1060 | 480 | 1060 | 1060 | 1060 | 1060 |
| Zn content from Component (E) | | mass ppm | 280 | 280 | 280 | 280 | 280 | 140 | 280 | 280 | 280 | 280 | 280 | 280 |
| Mo content from Component (F) | | mass ppm | 0 | 0 | 0 | 0 | 0 | 0 | 0 | 0 | 0 | 0 | 0 | 0 |
| Hot tube test | | | | | | | | | | | | | | |
| Rating (330° C.) | | | 7.5 | 7.5 | 7.0 | 8.5 | 8.5 | 7.5 | 8.0 | 8.5 | 7.5 | 8.5 | 8.5 | 8.5 |
| Rating (335° C.) | | | 6.0 | 0.5 | 3.5 | 7.5 | 7.5 | 7.5 | 8.0 | 8.0 | 6.0 | 7.5 | 8.5 | 8.5 |
| PDSC (Autoignition temperature) | | | | | | | | | | | | | | |
| Heat generation beginning temp. | | ° C. | 262 | 264 | 266 | 270 | 270 | 266 | 271 | 272 | 266 | 272 | 265 | 273 |

TABLE 2

| | | | Examples | | | | | | |
|---|---|---|---|---|---|---|---|---|---|
| | | | 13 | 14 | 15 | 16 | 17 | 18 | 19 |
| Base oil 1 | Group I, 500N | inmass % | 62 | 62 | 62 | 62 | 62 | 62 | 62 |
| Base oil 2 | Group I, ISO460 | inmass % | 38 | 38 | 38 | 38 | 38 | 38 | 38 |
| A-3 | Ca salicylate | mass % | 8 | 8 | 8 | 8 | 8 | 8 | 8 |
| B-1 | Neutral Ca sulfonate | mass % | 2 | 2 | 2 | 2 | 2 | 2 | 2 |
| C-2 | Basic Ca phenate | mass % | 2 | 2 | 2 | 2 | 2 | 2 | 2 |
| D-1 | Amine antioxidant | mass % | 0.75 | 0.75 | 0.75 | 0.75 | 0.75 | 0.75 | 0.75 |
| E-1 | ZnDTP | mass % | 0.4 | 0.4 | 0.4 | 0.4 | 0.4 | 0.4 | 0.4 |
| F-1 | MoDTC | mass % | 0.2 | 0.4 | 1 | — | — | — | — |
| F-2 | MoDTP | mass % | — | — | — | 1.2 | — | — | — |
| F-3 | M0-polyisobutenylsuccinimide complex | mass % | — | — | — | — | 4 | — | — |
| F-4 | Dialkylamine salt of molybdic acid | mass % | — | — | — | — | — | 1 | — |
| F-5 | Mo-ester amide complex | mass % | — | — | — | — | — | — | 1.25 |
| G-1 | Ashless dispersant | mass % | 3 | 3 | 3 | 3 | 3 | 3 | 3 |
| Base number | | mgKOH/g | 20 | 20 | 20 | 20 | 20 | 20 | 20 |
| Sulfated ash content | | mass % | 2.78 | 2.86 | 3.10 | 3.10 | 3.02 | 3.10 | 3.10 |
| Ca content from Component (A) | | mass % | 0.64 | 0.64 | 0.64 | 0.64 | 0.64 | 0.64 | 0.64 |
| Ca content from Component (B) | | mass ppm | 500 | 500 | 500 | 500 | 500 | 500 | 500 |
| Ca content from Component (C) | | mass ppm | 1060 | 1060 | 1060 | 1060 | 1060 | 1060 | 1060 |
| Zn content from Component (E) | | mass ppm | 280 | 280 | 280 | 280 | 280 | 280 | 280 |
| Mo content from Component (F) | | mass ppm | 200 | 400 | 1000 | 1000 | 600 | 1000 | 1000 |
| Hot tube test | | | | | | | | | |
| Rating (330° C.) | | | 8.5 | 8.5 | 8.5 | 8.5 | 8.5 | 8.5 | 8.5 |
| Rating (335° C.) | | | 7.5 | 7.5 | 7.5 | 7.5 | 7.5 | 7.5 | 7.5 |
| PDSC (Autoignition temperature) | | | | | | | | | |
| Heat generation beginning temp. | | ° C. | 267 | 267 | 275 | 269 | 270 | 270 | 268 |

TABLE 3

| | | | Comparative Examples | | | | | | | |
|---|---|---|---|---|---|---|---|---|---|---|
| | | | 1 | 2 | 3 | 4 | 5 | 6 | 7 | 8 |
| Base oil 1 | Group I, 500N | inmass % | 62 | 62 | 62 | 62 | 62 | 62 | 62 | 62 |
| Base oil 2 | Group I, ISO460 | inmass % | 38 | 38 | 38 | 38 | 38 | 38 | 38 | 38 |
| A-1 | Ca phenate | mass % | 10.8 | 10.8 | 10.8 | 10.8 | — | — | — | — |
| A-3 | Ca salicylate | mass % | — | — | — | — | 12.2 | 12.2 | 12.2 | — |
| B-1 | Neutral Ca sulfonate | mass % | — | — | 2 | — | — | 1 | 1 | 2 |
| C-2 | Basic Ca phenate | mass % | — | 2 | 2 | 2 | — | 1 | 1 | 2 |
| D-1 | Amine antioxidant | mass % | — | 0.5 | 0.5 | 0.5 | — | — | — | 0.5 |
| E-1 | ZnDTP | mass % | — | — | — | 0.4 | — | 0.2 | 0.2 | 0.4 |
| G-1 | Ashless dispersant | mass % | — | — | — | — | — | — | — | 3 |
| A'-1 | Ca salicylate | mass % | — | — | — | — | — | — | — | 8.4 |
| A'-2 | Ca sulfonate | mass % | — | — | — | — | — | — | — | — |
| D'-1 | Phenothiazine | mass % | — | — | — | — | — | 0.5 | — | — |
| D'-2 | Phenol antioxident | mass % | — | — | — | — | — | — | 1 | — |
| Base number | | mgKOH/g | 30 | 30 | 30 | 30 | 30 | 30 | 30 | 30 |
| Sulfated ash content | | mass % | 3.31 | 3.67 | 3.84 | 3.72 | 3.58 | 3.35 | 3.35 | 3.89 |
| Ca content from Component (A'A') | | mass % | 1.00 | 1.00 | 1.00 | 1.00 | 0.98 | 0.98 | 0.98 | 0.96 |
| Ca content from Component (B) | | mass ppm | 0 | 0 | 500 | 0 | 0 | 250 | 250 | 500 |
| Ca content from Component (C) | | mass ppm | 0 | 1060 | 1060 | 1060 | 0 | 530 | 530 | 1060 |
| Zn content from Component (E) | | mass ppm | 0 | 0 | 0 | 280 | 0 | 140 | 140 | 280 |
| Mo content from Component (F) | | mass ppm | 0 | 0 | 0 | 0 | 0 | 0 | 0 | 0 |
| Hot tube test | | | | | | | | | | |
| Rating (330° C.) | | | 0.0 | choked | 5.5 | 3.5 | 0.0 | 6.0 | 7.0 | 8.0 |
| Rating (335° C.) | | | choked | choked | choked | choked | choked | 3.0 | 3.0 | 8.0 |
| PDSC (Autoignition temperature) | | | | | | | | | | |
| Heat generation beginning temp. | | ° C. | 254 | 260 | 261 | 261 | 261 | 261 | 261 | 261 |

| | | Comparative Examples | | | | | |
|---|---|---|---|---|---|---|---|
| | | 9 | 10 | 11 | 12 | 13 | 14 |
| Base oil 1 | Group I, 500N | 62 | 62 | 62 | Commercially available cylinder oil A (17BN) | Commercially available cylinder oil B (25BN) | Commercially available cylinder oil C (70BN) |
| Base oil 2 | Group I, ISO460 | 38 | 38 | 38 | | | |
| A-1 | Ca phenate | — | — | — | | | |
| A-3 | Ca salicylate | — | — | — | | | |
| B-1 | Neutral Ca sulfonate | 2 | 2 | — | | | |
| C-2 | Basic Ca phenate | 2 | 2 | — | | | |
| D-1 | Amine antioxidant | 0.5 | 0.5 | — | | | |

TABLE 3-continued

| | | | | | | | |
|---|---|---|---|---|---|---|---|
| E-1 | ZnDTP | 0.4 | 0.4 | — | | | |
| G-1 | Ashless dispersant | 3 | 3 | — | | | |
| A'-1 | Ca salicylate | — | — | — | | | |
| A'-2 | Ca sulfonate | 8.44 | — | — | | | |
| D'-1 | Phenothiazine | — | — | — | | | |
| D'-2 | Phenol antioxident | — | — | — | | | |
| Base number | | 30 | 3 | 0 | 17 | 25 | 73 |
| Sulfated ash content | | 3.89 | 0.31 | 0.00 | 1.83 | 2.85 | 8.76 |
| Ca content from Component (A'A') | | 1.06 | 0 | 0 | — | — | — |
| Ca content from Component (B) | | 500 | 500 | 0 | — | — | — |
| Ca content from Component (C) | | 1060 | 1060 | 0 | — | — | — |
| Zn content from Component (E) | | 280 | 80 | 0 | — | — | — |
| Mo content from Component (F) | | 0 | 0 | 0 | 0 | 0 | 0 |
| Hot tube test | | | | | | | |
| Rating (330° C.) | | choked | choked | choked | 0.0 | 8.0 | 7.5 |
| Rating (335° C.) | | choked | choked | choked | choked | 8.0 | choked |
| PDSC (Autoignition temperature) | | | | | | | |
| Heat generation beginning temp. | | 255 | 246 | 245 | 255 | 257 | 267 |

(Evaluation Results)

The lubricating oil compositions (first lubricating oil composition) of Examples 1 to 19 had high autoignition temperature, and exhibited sufficient high-temperature detergency. The lubricating oil compositions of Comparative Examples 1 to 14 had autoignition temperature of less than 262° C., and some of them exhibited insufficient high-temperature detergency.

Second Lubricating Oil Composition: Examples 20 to 27 and Comparative Examples 15 to 21

Lubricating oil compositions of formulations shown in Tables 4 and 5 were prepared. In Tables 4 and 5, "in mass %" represents the content (unit: mass %) on the basis of the mass of the total base oils, "mass %" represents the content on the basis of the total mass of the composition (unit: mass %), and "mass ppm" represents the content on the basis of the total mass of the composition (unit: mass ppm).

Commercially available cylinder oil D: cylinder oil for crosshead engines containing an overbased Ca sulfonate, an overbased Ca phenate, and polyisobutenylsuccinimide, base number: 70 mgKOH/g, SAE 50

(Base Oil)

Base oil 5: 500N base oil, solvent-refined mineral oil, kinematic viscosity at 100° C.: 10.8 $mm^2/s$, sulfur content: 0.6 mass %, viscosity index: 97

Base oil 6: bright stock base oil, solvent-refined mineral oil, kinematic viscosity at 100° C.: 31.7 $mm^2/s$, sulfur content: 0.5 mass %, viscosity index: 96

(Component (B))

B-2: neutral Ca sulfonate, base number: 15 mgKOH/g, Ca content: 2.5 mass %, diluent oil content: 55 mass %

(Component (C))

C-3: neutral Ca phenate: base number: 70 mgKOH/g, Ca content: 2.4 mass %, metal ratio: 1.3, diluent oil content: 55 mass %

C-4: basic Ca phenate, base number: 145 mgKOH/g, Ca content: 5.3 mass %, metal ratio: 2.7, diluent oil content: 42 mass %

(Component (D))

D-3: alkylated diphenylamine (Component (E'))

E-3: ZnDTP, $R^3$=2-ethylhexyl group in the general formula (3), P content: 63 mass %

(Component (F))

G-2: bis-type polyisobutenylsuccinimide (Component (H))

H-1: Ca sulfonate, base number: 320 mgKOH/g, Ca content: 12.5 mass %, metal ratio: 11, diluent oil content: 43 mass %

H-2: Ca sulfonate, base number 400 mgKOH/g, Ca content: 15.5 mass %, metal ratio: 21, diluent oil content: 45 mass %

H-3: Ca phenate, base number 255 mgKOH/g, Ca content 9.25 mass %, metal ratio: 4.6, diluent oil content: 38 mass %

H-4: Ca salicylate, base number 170 mgKOH/g, Ca content: 6.3 mass %, metal ratio: 3.2, diluent oil content: 40 mass %

(Other Additives)

sulfurized fat sulfur content: 11.4 mass %

(High-Temperature Anti-Scuffing Performance Test)

High-temperature anti-scuffing performance of the lubricating oil compositions was evaluated. Friction coefficients while temperature of the test pieces was raised from 25° C. to 350° C. at a heating rate of 5° C./min were measured by means of a high-speed reciprocating friction machine (TE77 manufactured by Phoenix Tribology Ltd.), and a plate test piece TE77 100895B, and a cylinder test piece TE77 16916 as the test pieces under the conditions of load: 200 N, sliding amplitude: 15 mm, sliding frequency: 20 Hz, and oil supply: 50 mg/min. Before raising the temperature of the test pieces was started, the machine was run-in for 3 minutes at each load of 50 N, 100 N, 150 N, and 200 N in this order at 25° C. Temperature at which the friction coefficient suddenly rose was recorded as scuffing occurring temperature. The scuffing occurring temperature measured by this method is preferably no less than 320° C.

TABLE 4

| | | Examples | | | | | | | |
|---|---|---|---|---|---|---|---|---|---|
| | | 20 | 21 | 22 | 23 | 24 | 25 | 26 | 27 |
| Commercially available cylinder oil | | Balance | — | — | — | — | — | — | — |
| Base oil | | | | | | | | | |
| Base oil 5 | inmass % | — | 64 | 52 | 53 | 65 | 60 | 62 | 62 |
| Base oil 6 | inmass % | — | 36 | 48 | 47 | 35 | 40 | 38 | 38 |
| (B-2) Neutral sulfonate | mass % | 0.7 | 2.0 | 0.7 | 1.0 | 2.0 | 2.0 | 2.0 | 2.0 |
| (C-3) Neutral Ca phenate | mass % | — | 2.0 | — | — | — | — | — | — |
| (C-4) Basic Ca phenate | mass % | 0.7 | — | 0.7 | 1.0 | 2.0 | 2.0 | 2.0 | 2.0 |
| (D-3) Amine antioxidant | mass % | 0.17 | 0.50 | 0.17 | 0.25 | 0.50 | 1.00 | 0.50 | 0.50 |
| (E-3) ZnDTP | mass % | 0.17 | 0.55 | 0.17 | 0.25 | 0.55 | 0.55 | 0.55 | 0.55 |
| Sulfurized fat | mass % | — | — | — | — | — | — | — | — |
| (H) Metallic detergent | | | | | | | | | |
| (H-1) Ca sulfonate | mass % | — | 8.4 | 8.4 | 8.4 | 8.4 | — | — | — |
| (H-2) Ca sulfonate | mass % | — | — | — | — | — | 16.8 | — | — |
| (H-3) Ca phenate | mass % | — | — | — | — | — | — | 10.8 | — |
| (H-4) Ca salicylate | mass % | — | — | — | — | — | — | — | 16.0 |
| (G-2) Ashless dispersant | mass % | — | 3 | 1 | 1.5 | 3 | 3 | 3 | 3 |
| Kinematic viscosity (100° C.) | $mm^2/s$ | 21.4 | 20.5 | 20.5 | 20.5 | 20.5 | 20.5 | 20.5 | 20.5 |
| Base number (perchloric acid method) | mgKOH/g | 73.5 | 31.5 | 31.0 | 31.5 | 33.0 | 73.0 | 33.0 | 33.0 |
| Ca content from Component (B) | mass ppm | 250 | 500 | 180 | 250 | 500 | 500 | 500 | 500 |
| Ca content from Component (C) | mass ppm | 530 | 240 | 370 | 530 | 1060 | 1060 | 1060 | 1060 |
| P content from Component (E) | mass ppm | 130 | 350 | 110 | 160 | 350 | 350 | 350 | 350 |
| Ca content from Component (H) | mass % | 2.60 | 1.06 | 1.06 | 1.06 | 1.06 | 2.60 | 1.00 | 1.01 |
| High-temperature anti-scuffing performance test | | | | | | | | | |
| Scuffing occurring temp. | ° C. | 328 | 334 | 326 | 329 | 333 | 335 | 333 | 335 |

TABLE 5

| | | Comparative Examples | | | | | | |
|---|---|---|---|---|---|---|---|---|
| | | 15 | 16 | 17 | 18 | 19 | 20 | 21 |
| Commercially available cylinder oil D | | Balance | Balance | Balance | — | — | — | — |
| Base oil | | | | | | | | |
| Base oil 5 | inmass % | — | — | — | 46 | 45 | 45 | 45 |
| Base oil 6 | inmass % | — | — | — | 54 | 55 | 55 | 55 |
| (B-2) Neutral Ca sulfonate | mass % | — | — | — | — | — | — | — |
| (C-3) Neutral Ca phenate | mass % | — | — | — | — | — | — | — |
| (C-4) Basic Ca phenate | mass % | — | — | — | — | — | — | — |
| (D-3) Amine antioxidant | mass % | — | — | — | — | — | — | — |
| (E-3) ZnDTP | mass % | — | 0.95 | — | — | — | — | — |
| Sulfurized fat | mass % | — | — | 1.0 | — | — | — | — |
| (H) Metallic detergent | | | | | | | | |
| (H-1) Ca sulfonate | mass % | — | — | — | 8.4 | — | — | — |
| (H-2) Ca sulfonate | mass % | — | — | — | — | 16.8 | — | — |
| (H-3) Ca phenate | mass % | — | — | — | — | — | 10.8 | — |
| (H-4) Ca salicylate | mass % | — | — | — | — | — | — | 16.0 |
| (G-2) Ashless dispersant | mass % | — | — | — | 3 | 3 | 3 | 3 |
| Kinematic viscosity (100° C.) | $mm^2/s$ | 20.5 | 20.5 | 20.5 | 20.5 | 20.5 | 20.5 | 20.5 |
| Base number (perchloric acid method) | mgKOH/g | 72.6 | 72.6 | 72.6 | 30.0 | 70.0 | 30.0 | 30.0 |
| Ca content from Component (B) | mass ppm | — | — | — | 0 | 0 | 0 | 0 |
| Ca content from Component (C) | mass ppm | — | — | — | 0 | 0 | 0 | 0 |
| P content from Component (E) | mass ppm | 0 | 600 | 0 | 0 | 0 | 0 | 0 |
| Ca content from Component (H) | mass % | 2.60 | 2.60 | 2.60 | 1.06 | 2.60 | 1.00 | 1.01 |
| High-temperature anti-scuffing performance test | | | | | | | | |
| Scuffing occurring temp. | ° C. | 301 | 305 | 295 | 311 | 277 | 315 | 312 |

(Evaluation Results)

The lubricating oil compositions of Examples 20 to 27 had scuffing occurring temperature of no less than 320° C., and exhibited good high-temperature anti-scuffing performance. On the other hand, the lubricating oil compositions of Comparative examples 15 to 21 were inferior in high-temperature anti-scuffing performance.

I claim:

1. A cylinder lubricating oil composition for a crosshead diesel engine, the composition having:

a sulfated ash content of 2.0 to 5.5 mass %;

a base number of 15 to 45 mgKOH/g;

a kinematic viscosity at 100° C. of 12.5 $mm^2/s$ or more; and an autoignition temperature of no less than 262° C., wherein the autoignition temperature is determined by means of pressurized differential scanning calorimetry as a temperature at which the composition begins to generate heat when 3 mg of the composition is heated in an oxygen atmosphere at a pressure of 1.0 MPa from 25° C. to 500° C. at a heating rate of 10° C./min, the composition comprising:

a lubricant base oil;

(A) at least one of a Ca salicylate detergent having a metal ratio of no more than 7 or a Ca phenate detergent having a metal ratio of no more than 7;

(B) a Ca sulfonate detergent having a base number of no less than 10 mgKOH/g and less than 60 mgKOH/g;

(C) a Ca phenate detergent having a base number of 55 to 200 mgKOH/g;

(D) at least one of an amine antioxidant or a sulfur-containing compound; and (E) a zinc dithiophosphate or a zinc dithiocarbamate, wherein the sulfur-containing compound is a compound other than a metallic detergent, a zinc dithiophosphate, a zinc dithiocarbamate, an oil-soluble organic molybdenum compound, and an ashless detergent; and the lubricant base oil consists of one or more selected from the group consisting of Group I base oil of API base stock categories and Group II base oil of API base stock categories.

2. The cylinder lubricating oil composition according to claim 1, the composition being used for lubrication of a crosshead diesel engine, the crosshead diesel engine using a fuel, the fuel having a flash point of no more than 15° C.

3. The cylinder lubricating oil composition according to claim 1, the composition being used for lubrication of a crosshead diesel engine, the crosshead diesel engine using a fuel, the fuel comprising a hydrocarbon having 1 to 4 carbons.

4. The cylinder lubricating oil composition according to claim 1, the composition being used for lubrication of a crosshead diesel engine, the crosshead diesel engine using a fuel, the fuel comprising methane, ethane, ethylene, propane, butane, methanol, ethanol, dimethyl ether, or combination thereof.

5. The cylinder lubricating oil composition according to claim 1, the composition comprising:

the component (B) in an amount of 100 to 1000 mass ppm in terms of Ca on the basis of the total mass of the composition;

the component (C) in an amount of 200 to 2000 mass ppm in terms of Ca on the basis of the total mass of the composition;

the component (D) in an amount of 0.10 to 5.0 mass % on the basis of the total mass of the composition; and the component (E) in an amount of 100 to 700 mass ppm in terms of Zn on the basis of the total mass of the composition.

6. The cylinder lubricating oil composition according to claim 1, the component (D) comprising one or more selected from the group consisting of: alkylated diphenylamine, alkylated phenyl-α-naphthylamine, phenyl-α-naphthylamine, phenyl-β-naphthylamine, thiadiazole, disulfides, sulfurized fats, polysulfides, and sulfurized olefins.

7. The cylinder lubricating oil composition according to claim 1, further comprising:

(F) an oil-soluble organic molybdenum compound.

8. The cylinder lubricating oil composition according to claim 7, the component (F) comprising one or more selected from the group consisting of: molybdenum dithiocarbamate, molybdenum dithiophosphate, molybdenum-polyisobutenylsuccinimide complex, and dialkylamine salt of molybdic acids; and the composition comprising the component (F) in an amount of no less than 100 mass ppm in terms of Mo on the basis of the total mass of the composition.

9. The cylinder lubricating oil composition according to claim 1, further comprising:

(G) an ashless dispersant having a number average molecular weight of no less than 2500, wherein a product of the number average molecular weight of the component (G) and a concentration (unit: mass %) of the component (G) in the composition is no less than 9000.

10. A method for lubricating a cylinder of a crosshead diesel engine, the method comprising:

(a) operating a crosshead diesel engine using a fuel, the fuel having a flash point of no more than 15° C.; and (b) supplying the cylinder lubricating oil composition as in claim 1 to a cylinder of the crosshead diesel engine.

11. The method for lubricating the cylinder of the crosshead diesel engine according to claim 10, wherein the fuel comprises a hydrocarbon having 1 to 4 carbons.

12. The method for lubricating the cylinder of the crosshead diesel engine according to claim 10, wherein the fuel comprises methane, ethane, ethylene, propane, butane, methanol, ethanol, dimethyl ether, or combination thereof.

* * * * *